United States Patent [19]

Benscoter et al.

[11] Patent Number: 4,857,016

[45] Date of Patent: Aug. 15, 1989

[54] COMPONENTS FOR FLEXIBLE WIRING SYSTEMS

[75] Inventors: Richard D. Benscoter, Vienna, W. Va.; Charles Domigan, Coolville, Ohio; Charles T. Flachbarth, Parkersburg, W. Va.; James E. Sheridan, Williamstown, both of W. Va.

[73] Assignee: Butler Manufacturing Company, Kansas City, Mo.

[21] Appl. No.: 480,470

[22] Filed: Mar. 30, 1983

[51] Int. Cl.[4] ..... H01R 13/64

[52] U.S. Cl. ..... 439/680; 439/557; 439/638

[58] Field of Search ..... 339/154 R, 154 A, 156 R, 339/176 M, 184 M, 186 M, 206 P, 207 R, 208, 209, 219 S, 49 R, 128, 28, 29 R; 439/638, 677, 679, 680, 681, 746, 557

[56] References Cited

U.S. PATENT DOCUMENTS

| | | | |
|---|---|---|---|
| 3,514,743 | 5/1970 | Schantz | 339/128 |
| 4,206,958 | 6/1980 | Hau et al. | 339/49 R |
| 4,437,725 | 3/1984 | Eaby et al. | 339/156 R |
| 4,443,048 | 4/1984 | Moist | 339/217 S X |

*Primary Examiner*—Eugene F. Desmond
*Attorney, Agent, or Firm*—Frederick J. Olsson

[57] ABSTRACT

Each component includes one or more sets of pin and/or socket contacts each set being mounted on a contact block. The contact block has shield means surrounding the contacts and around each shield means in an outer housing. The shields and housing electrically and mechanically isolate the contacts.

5 Claims, 11 Drawing Sheets

WIRE CONNECTOR

Fig. 2-A

CABLE COUPLER

WIRING ADAPTOR

CABLE HEAD

MODULAR SWITCHING TAP

COMPONENTS FOR FLEXIBLE WIRING SYSTEMS

DISCLOSURE

This invention relates in genral to electrical power distribution systems for buildings or the like.

More specifically the invention relates to flexible wiring power distribution systems used in an environmental air space or a plenum above a suspended ceiling and in such a space or plenum underneath a raised floor.

The invention contemplates improved structure for components employed in flexible wiring systems particularly flexible cable sets, cable heads, cable couplers, wiring adaptors, wire connectors, and modular switch taps.

The principal objective of the invention is to improve the useful arts of electrical power distribution systems for buildings by providing improved structures which create the prime advantage of making it possible for the first time to use pin and socket contacts for flexible wiring systems employed in buildings.

According to the invention each set of pin and/or socket contacts is mounted within protective male and female shield structures, each contact being independently housed within a small diameter, cylindrical bore formed in its shield. The end of each contact is recessed inwardly from the end of its bore; i.e. the shield overlies the ends of the contacts. Each shield is surrounded by a protective skirt or outer housing and the end of each outer housing also overlies the ends of the contacts.

When a cable head is plugged into a component, the male and female shields and the outer housings nest together and are dimensioned in diameter and length to cause the head to be very firm on the component. When the shields and outer housings are nested together, the pin and socket contacts are likewise nested together in ideal electrical engagement.

When a cable head is plugged into a component, the shields and outer housings nest together before the ends of the contacts engage. This is due to the overlie structure. When a cable head is disconnected, the ends of the contacts disengage before the shields and outer housings separate.

Further, according to the invention, the cable head, the cable coupler, the wiring adaptor, the wire connector, and the modular switch tap each have a unique structure which permits fabrication from plastic material. Accordingly, manufacture is accomplished by the molding of a component as a whole unit and by molding some components in separate parts and assembling the parts by the use of high speed sonic welding techniques.

The above structure produces the several critical and outstanding advantages noted below.

PROTECTIVE BANDS

When a cable head is plugged into another component, each set of nested contacts is surrounded by four bands of protective insulating material. Two bands are formed by the shields and two are bands formed by the outer housings. The bands mechanically and electrically isolate the contacts.

ARC QUENCHING

If a cable head is disconnected under load (which should not be done), the nested shields and outer housings remain around the contacts at the time of contact separation. Therefore, there is a mass of insulating material available for the quenching of any arc that develops. Burn and explosive hazards are minimized.

SHOCK HAZARD REDUCED

With overlie structure and with the diameter of the bores in the shields being relatively small, the ends of the contacts are out of reach of the fingers and most tools. The likelihood of electrical shock to an installing electrician is minimized.

Moreover, for those components which require assembly of parts, the same are structured so the assembly thereof can only be completed if the parts are aligned so that they go together whereby that the completed unit is arranged in a manner minimizing the likelihood of an electrician on the job erroneously plugging in a cable head.

AXIAL ALIGNMENT

When a cable head is plugged into a component, the nesting of the overlie structure axially aligns the pin and socket contacts prior to their engagement. The nesting maintains that alignment during the time the contacts are sliding together Maximum surface area engagement of the contacts is obtained and maintained.

ANTI-WOBBLE

The nesting of the shields and outer housings prevents cocking or lateral displacement of the cable head (hence prevents shifting of the nested contacts) if the head is struck by the hand or by the foot or by a tool of an electrician or some other craftsman working in the flexible systems area. Maximum surface area engagement of the contacts is not disturbed.

LOW COST

The designs of the various components to permit the use of conventional molding and sonic welding techniques is vitally important in as much as this significantly contributes to reducing manufacturing costs, hence, low cost to the building owner.

The invention will be described below in connection with the following drawings wherein.

Figure 1:
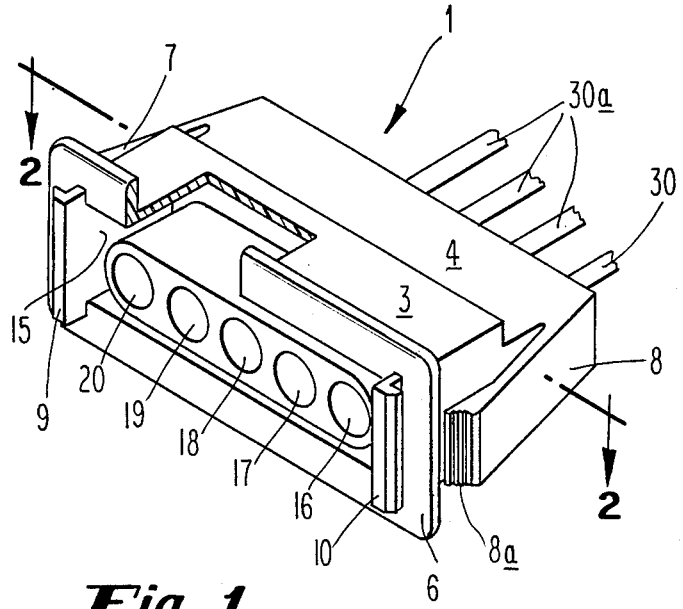
FIG. 1 is a perspective view of a wire connector.
Figure 2:
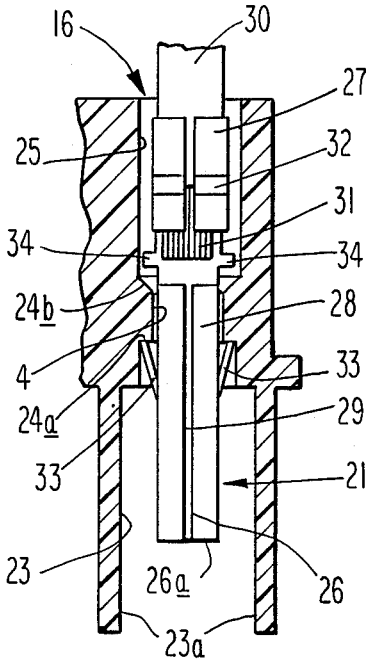
FIG. 2 is a sectional view taken along the lines 2—2 of FIG. 1.
Figure 2:
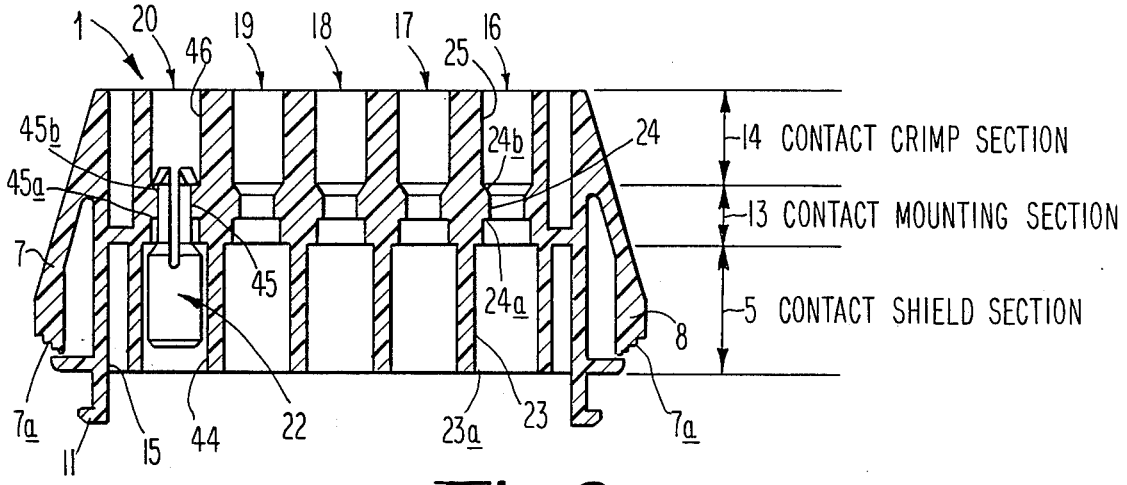
Figure 3:
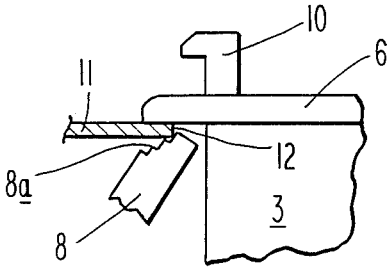
Figure 4:
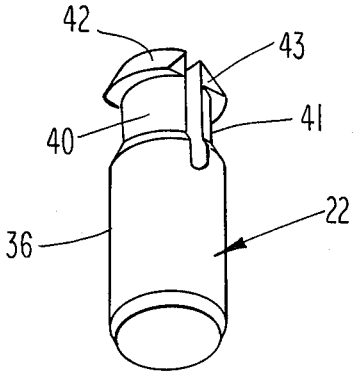
Figure 5:
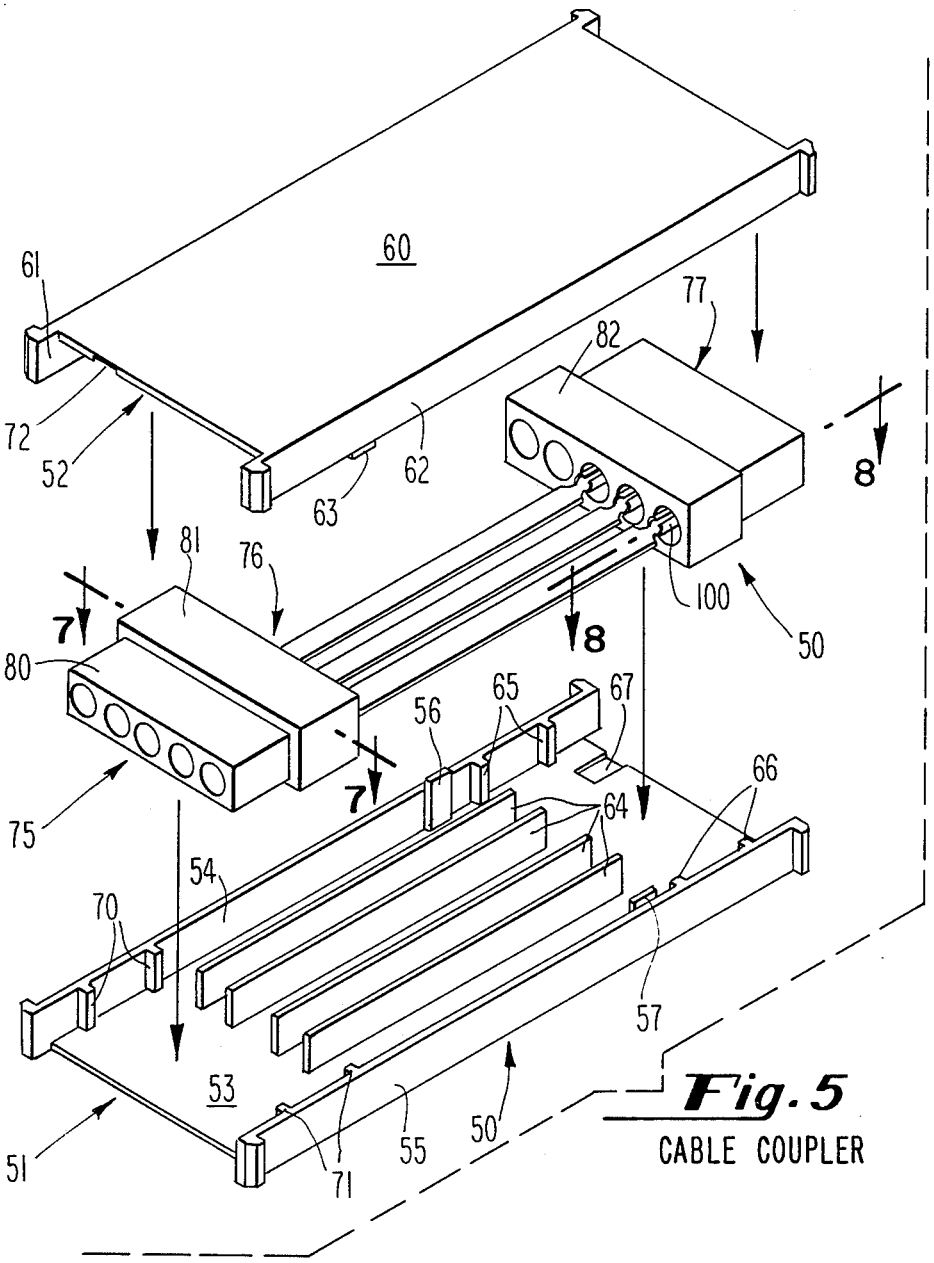
Figure 6:
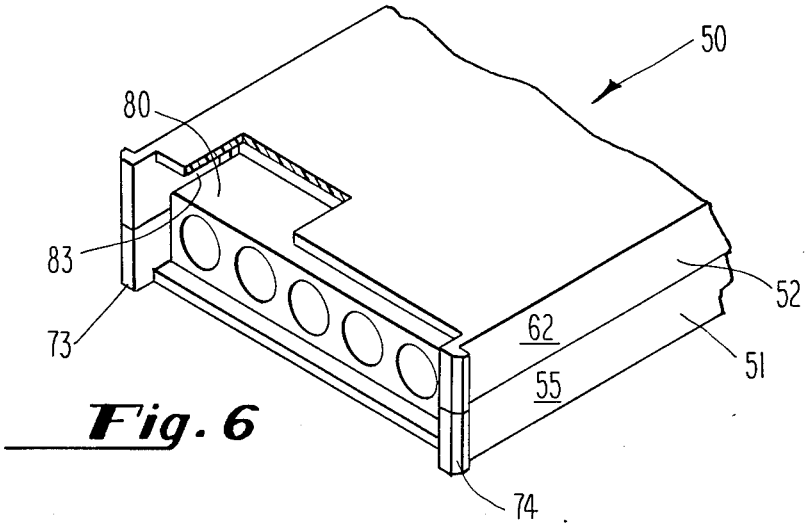
Figure 7:
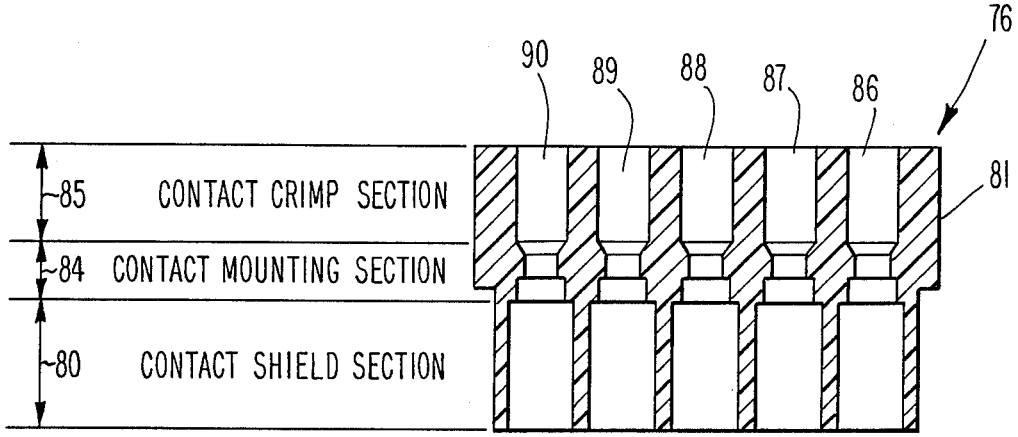
Figure 8:
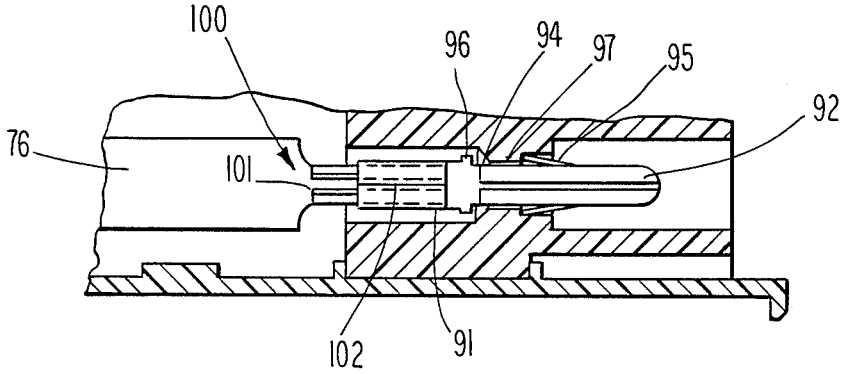
Figure 9:
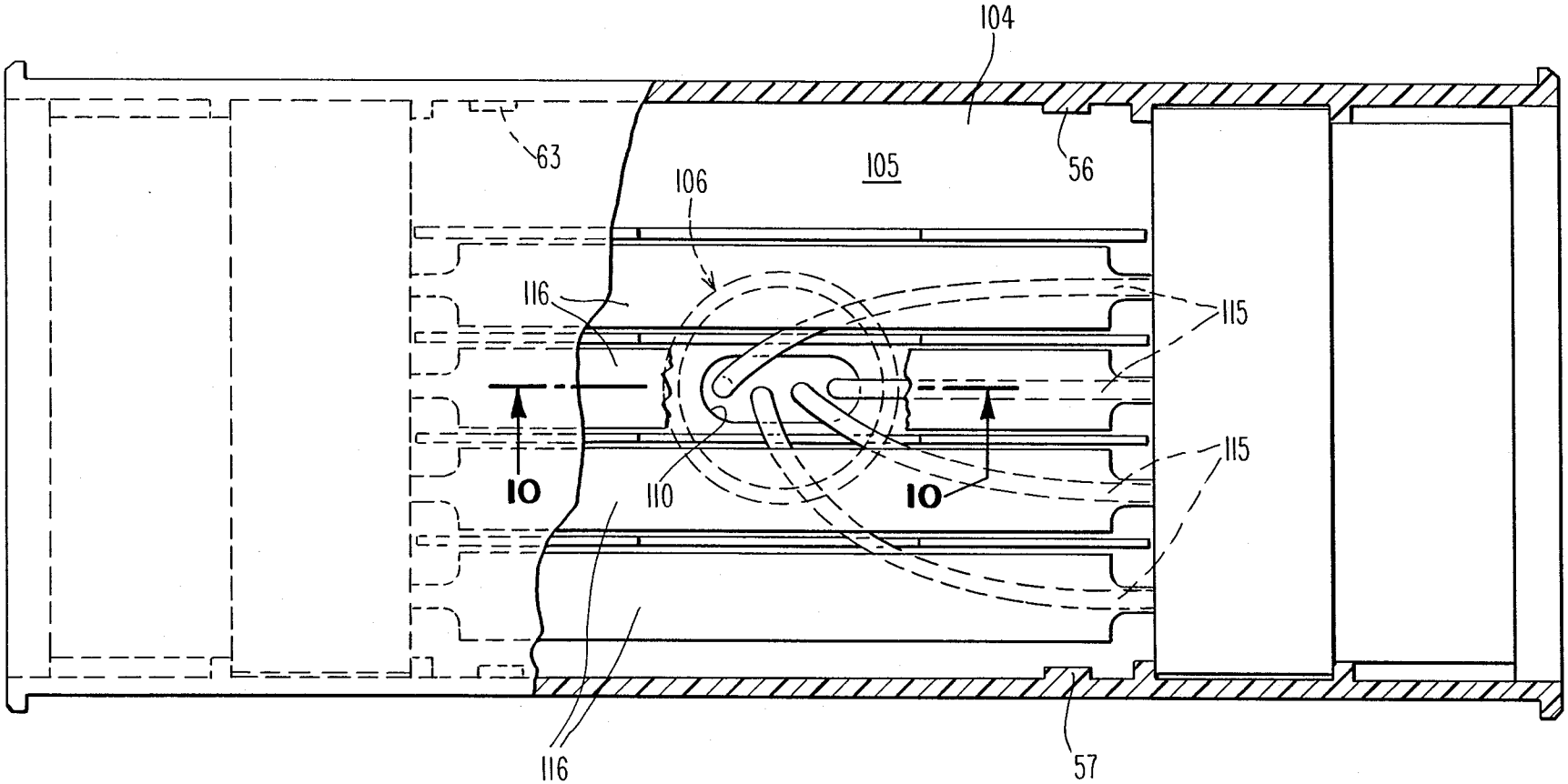
Figure 11:
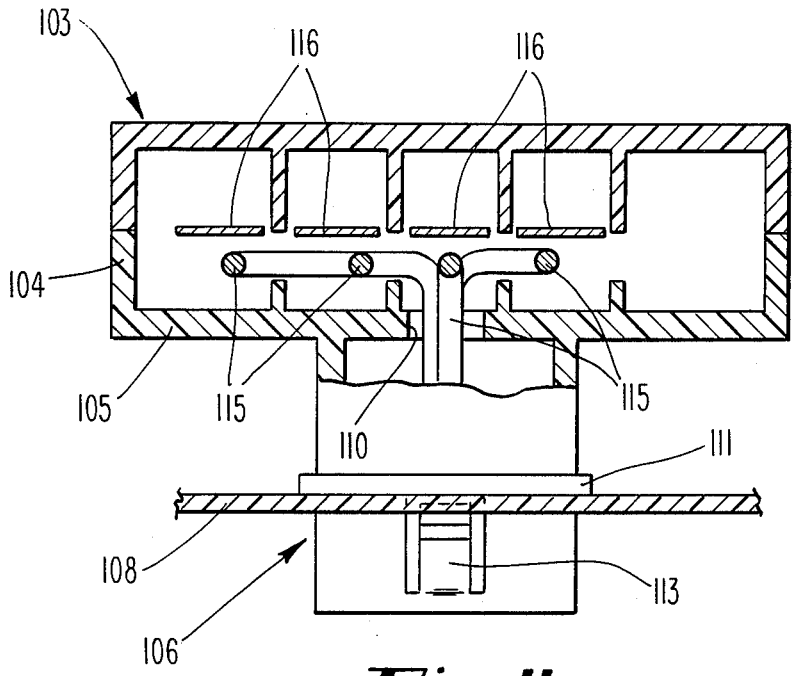
Figure 10:
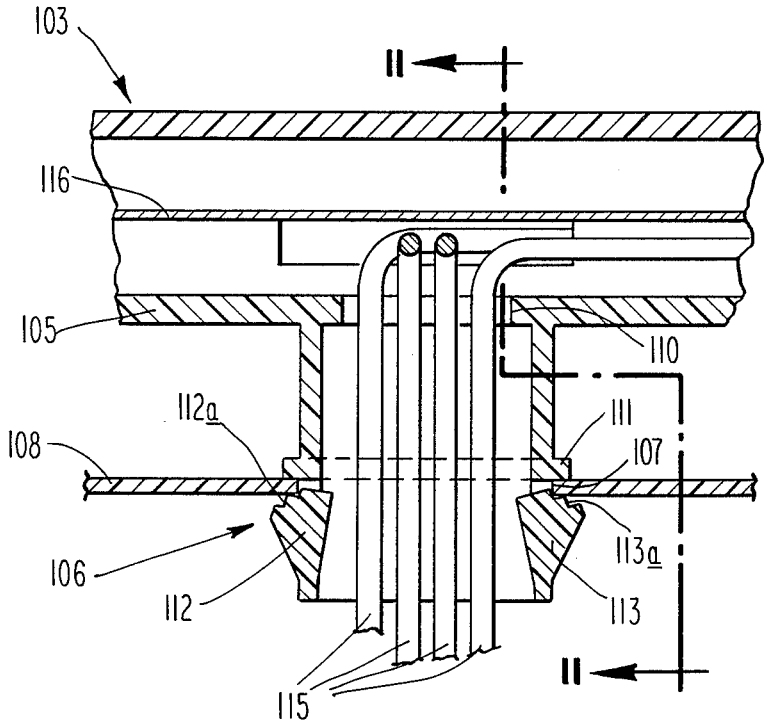
Figure 12:
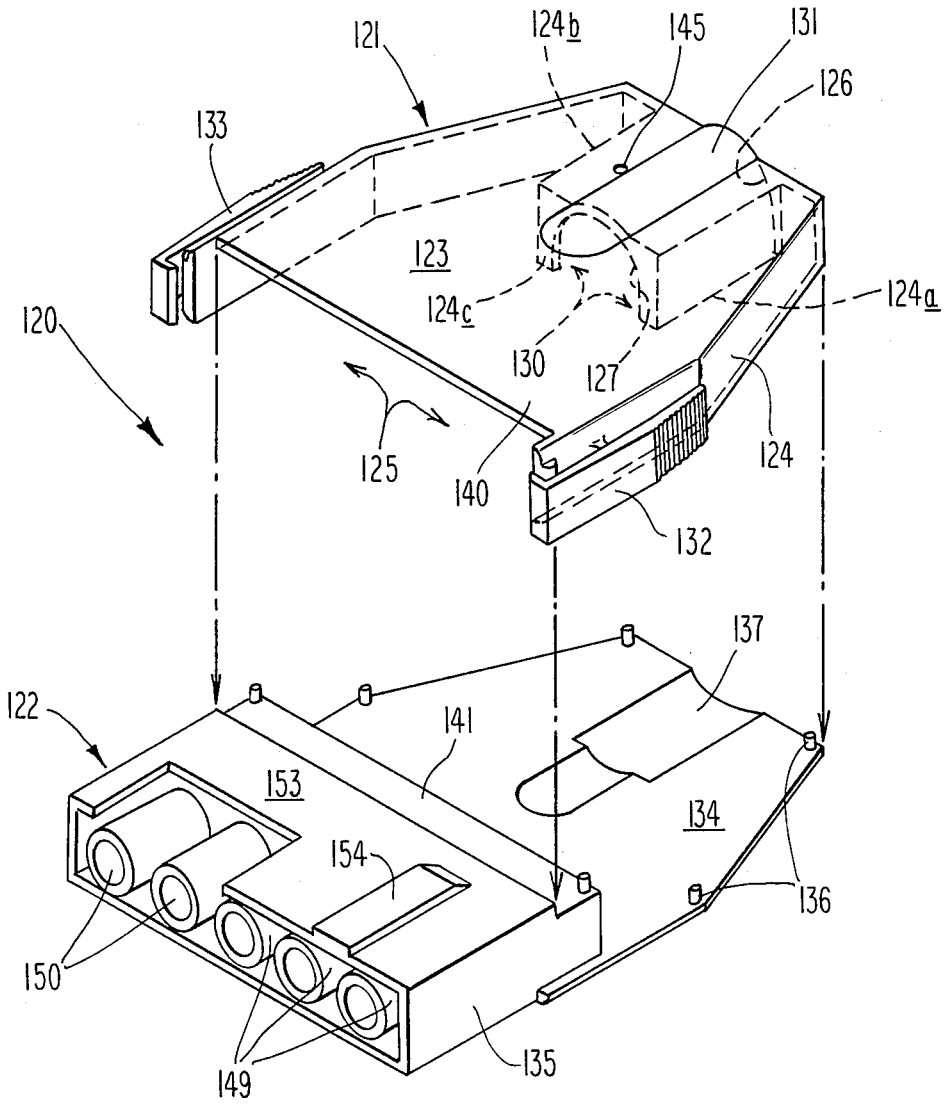
Figure 13:
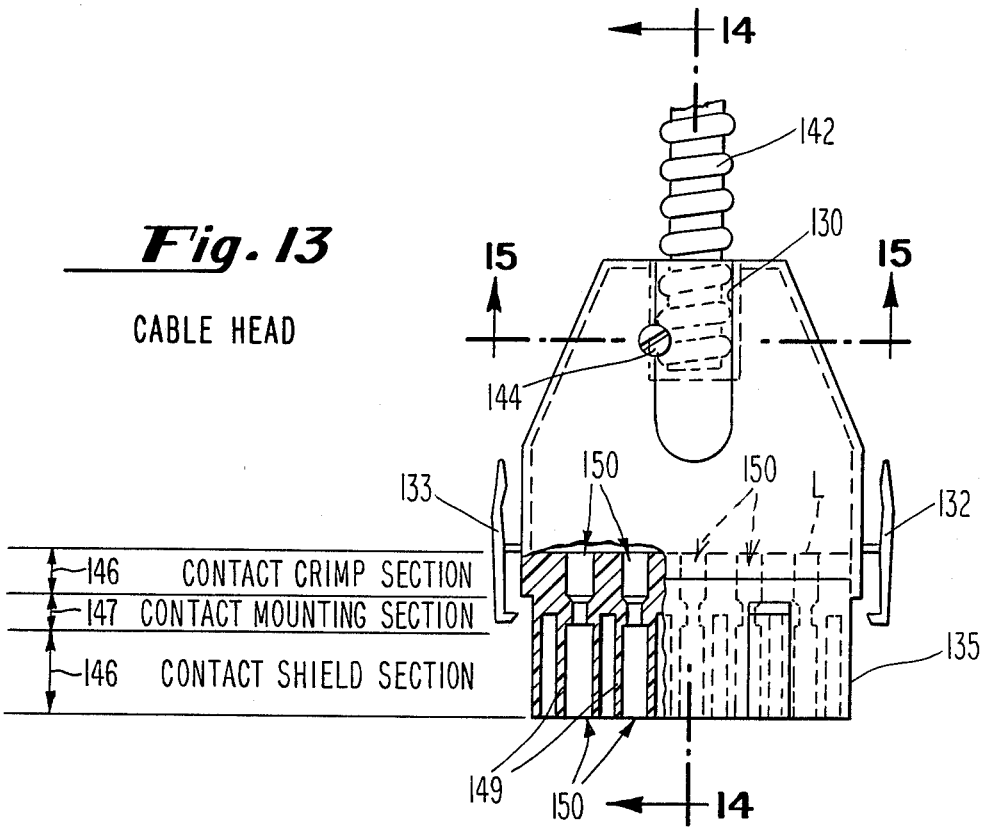
Figure 14:
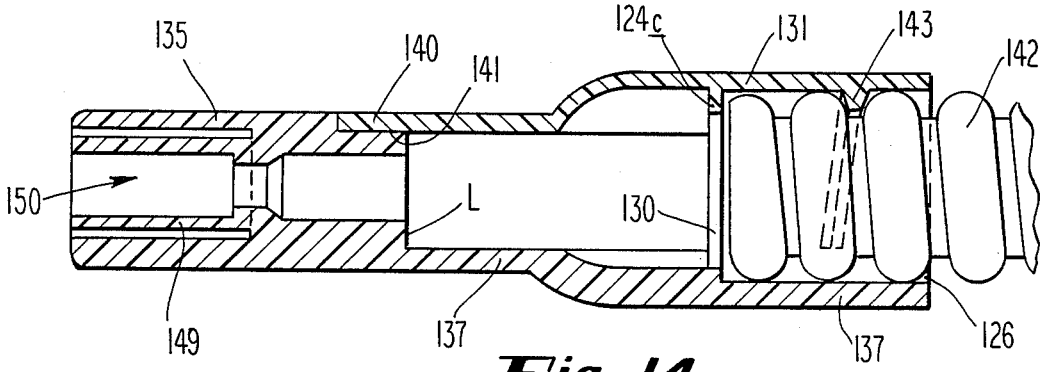
Figure 15:
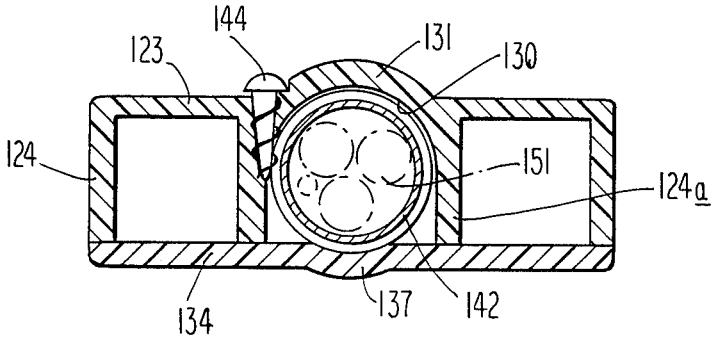
Figure 16:
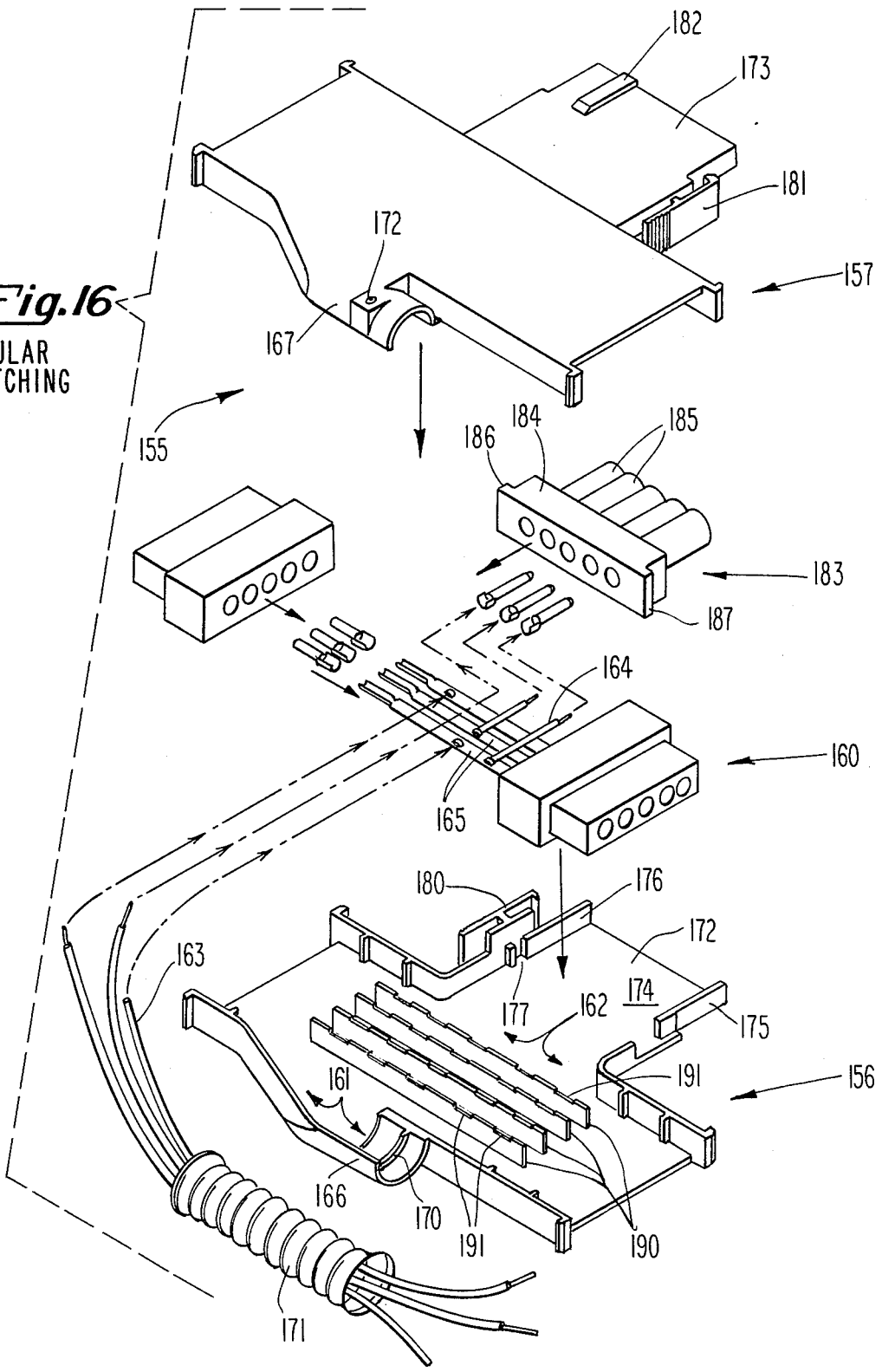
Figure 17:
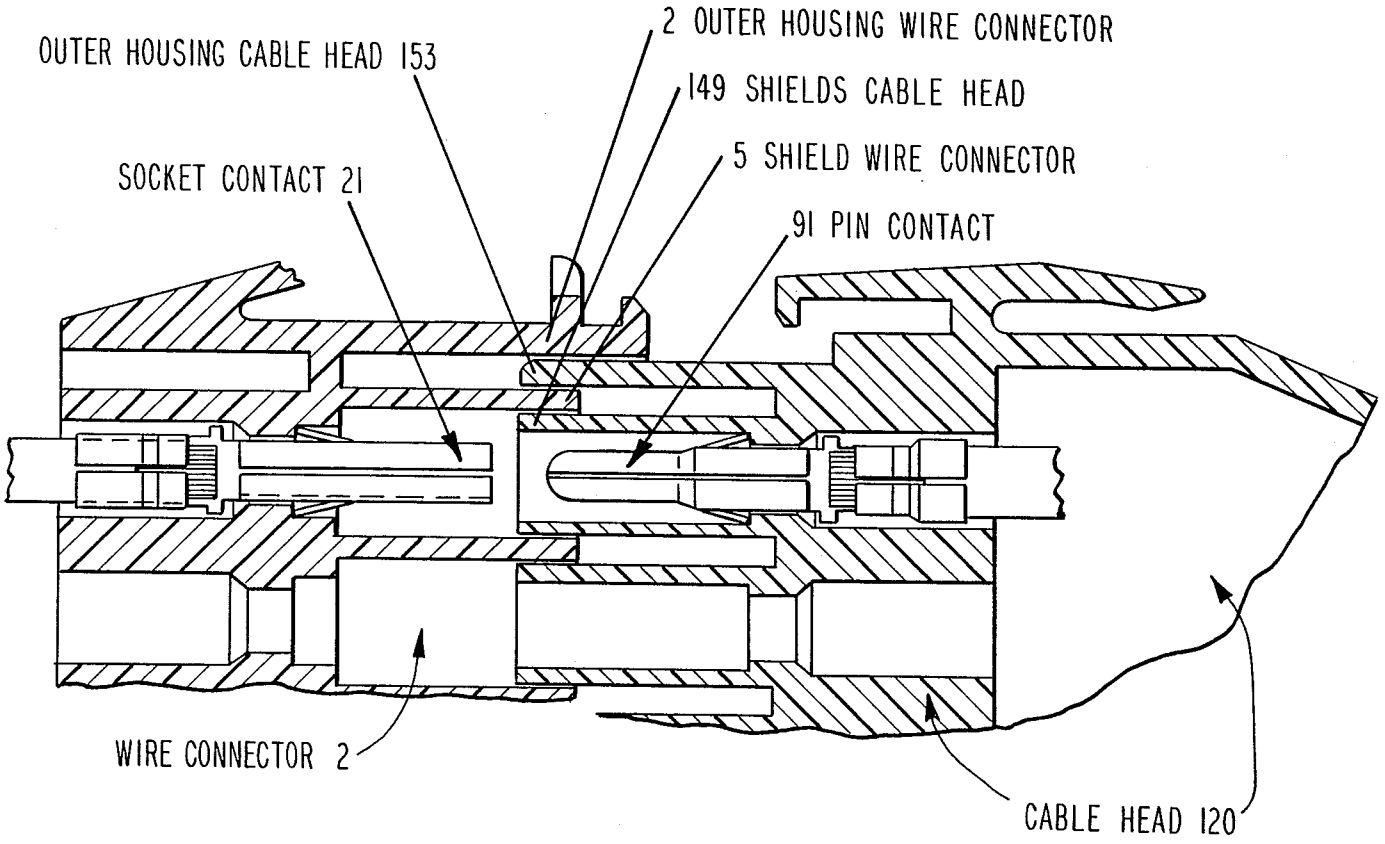
Figure 18:
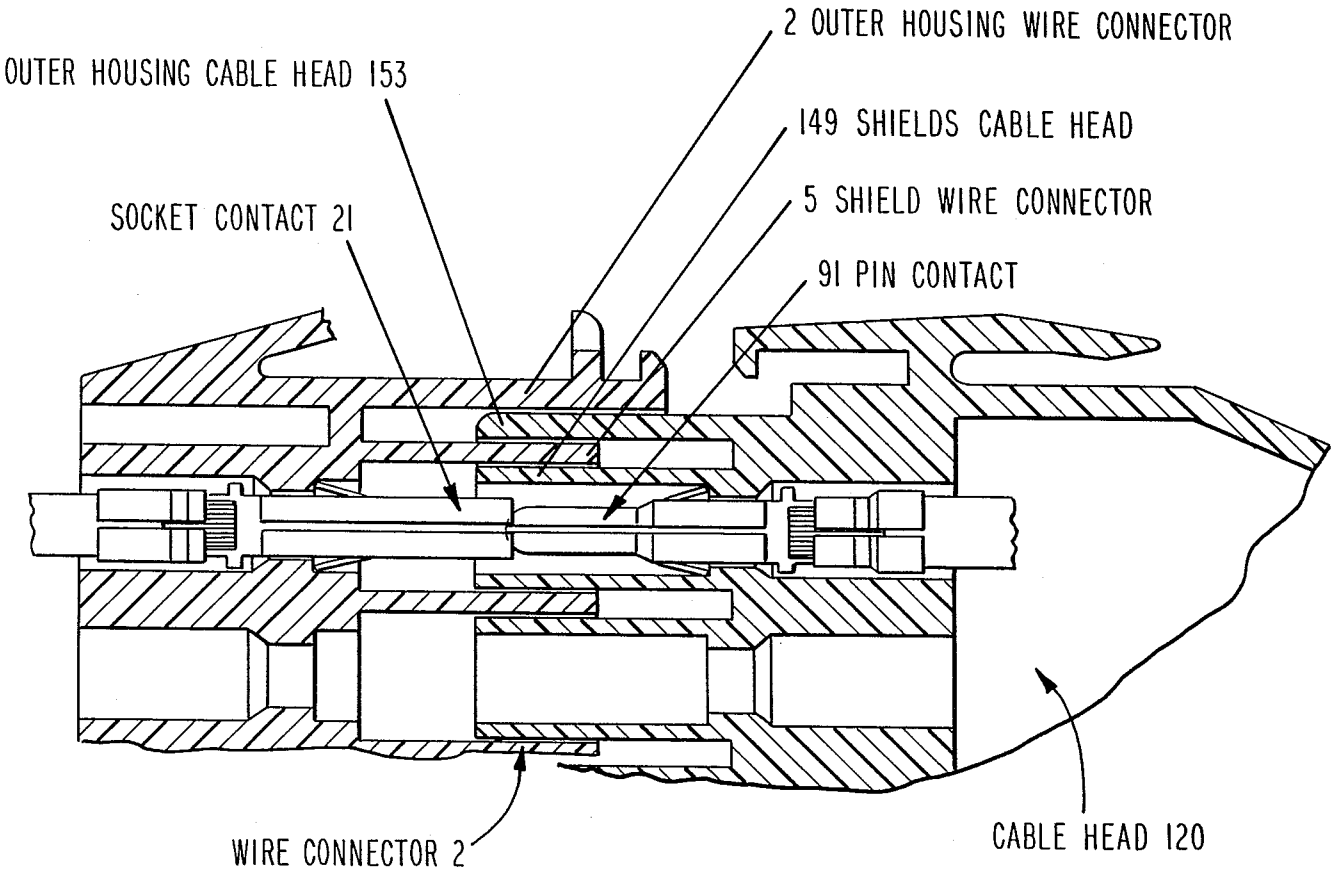
Figure 19:
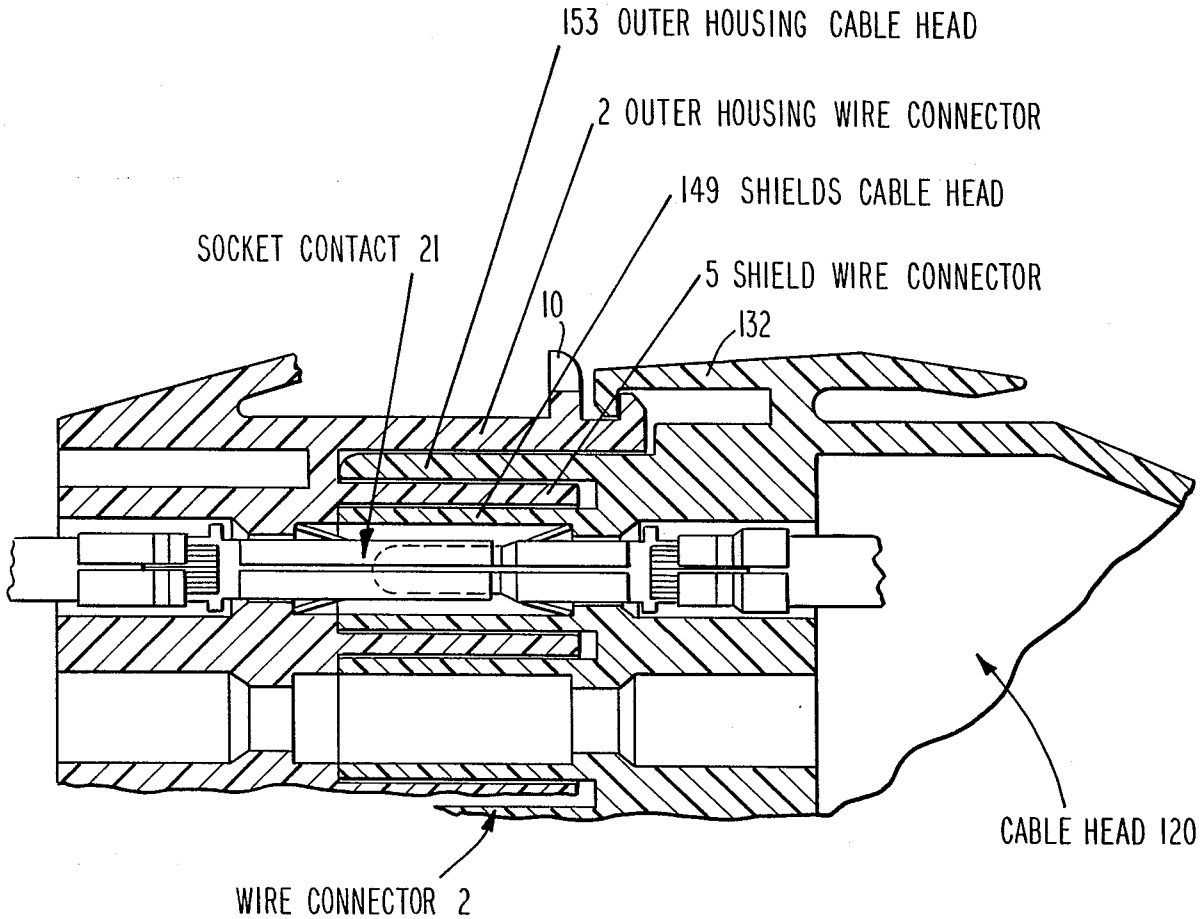

FIG. 2-A is an enlarged fragmentary view of a contact mounted in the wire connector of FIG. 1;

FIG. 3 is a fragmentary view illustrating how the wire connector of FIG. 1 is mounted in an operating position;

FIG. 4 is a perspective view of a fill-in pin;

FIG. 5 is an exploded perspective view of the components of a cable coupler;

FIG. 6 is a fragmentary view, partially broken away, of the component of FIG. 5 joined together;

FIG. 7 is a section view taken along the lined 7—7 of FIG. 5;

FIG. 8 is an enlarged fragmentary view taken along the lines 8—8 of FIG. 5;

FIG. 9 is a plan view particularly broken away of a wiring adaptor;

FIG. 10 is an enlarged view taken along the lines 10—10 of FIG. 9;

FIG. 11 is a sectional elevational view taken along the lines 11—11 of FIG. 10;

FIG. 12 is an exploded perspective view of components of a cable head;

FIG. 13 is a plan view particularly broken away with the components of FIG. 12 joined together and supporting a flexible cable, the sheath only of the flexible cable being illustrated;

FIG. 14 is an enlarged view taken along the lines 14—14 of FIG. 13;

FIG. 15 is an enlarged view taken along the lines 15—15 of FIG. 13;

FIG. 16 is an exploded perspective view of the components of a modular switching tap;

FIGS. 17, 18, and 19 are sectional, elevational views of a cable head being plugged into a wire connector and illustrating certain advantages mentioned heretofore;

The various components about to be described are each structured so the same can be fabricated from plastic material by conventional injection molding techniques. The particular material found most suitable from the standpoint of strength and fire resistance is ULTEM plastic manufactured by the General Electric Company with a 10% glass content added to improve the anti-burning characteristics. FIGS. 1 and 2 illustrate the construction of a wire connector generally indicated at 1. This is a component which is mounted on a flat support wall of a unit in a power distribution system and electrically connected to the mechanism inside the unit. A cable head is plugged into the wire connector. Power is transferred in and out of the unit as the application requires. Such a power distribution unit may be a lighting fixture mounted in a suspended ceiling to supply light to a room or a junction unit which serves as a conversion point as between the hard wiring and the flexible wiring system of the building.

The wire connector 1 has an outer housing 2 which includes the enlarged extension 3 and an outside smaller section 4 and an inside shield section 5. The periphery of the extention 3 is generally rectangular. The outer edge of the extension 3 carries a flange 6. On opposite sides of the wire connector 1 are flexible fingers 7 and 8. Each finger is connected to the small section 4 of the outer housing and extends toward the flange 6. The top of each finger is stepped as noted at 7*a* and 8*a*. Extending outwardly from the flange 5 are a pair of L-shaped keepers 9 and 10. These keepers are for use in engaging releasible latch fingers on a cable head to maintain the head and wire connector together.

The wire connector 1 is adapted to be mounted on a support wall of a unit in a power distribution system as indicated in FIG. 3. The support wall 11 has an opening 12 larger than the section 3 so that the connector can be pushed down into the opening 12 (with the finger 7 and 8 flexing inwardly) until the underside of the flange 6 contacts the top surface of the wall,ll. At that time, the finger will be flexed outwardly so that one of the steps 6*a* and 7*a* engage the edge and underside of the wall 11 to secure the connector on position.

The sections 4 and 5 of the outer housing constitute a contact block which in general is divided (FIG. 2) into three sections, i.e. the contact shield section 5, a contact mounting section 13, and a contact crimp section 14. The exterior peripheral surface of the contact shield section 5 forms.an exterior support surface. The inside of the extension 3 forms an interior support surface 15 which faces the exterior support surfaces. These interior and exterior support surfaces are employed for the nesting condition which occurs when a cable head is plugged into a wire connector as noted later on.

The contact shield section 5, the contact mounting section 13, and the contact crimp section 14 are provided with bores which form a plurality of identical, parallel contact cavities 16, 17, 18, 19, and 20 adapted to carry contacts or a fill-in pin. For the wire connector, socket-type contacts are preferably employed.

To illustrate the mounting of the contacts and fill-in pin in the wire connector we have shown a contact 21 (FIG. 2-A) and a fill-in pin 22 (FIG. 2) respectively mounted in the cavities 16 and 20. In the arrangement shown, the cavities 17, 18, and 19 would carry similar contacts. It will be understood that the contacts and fill-in pin may be set up in any desired manner. For descriptive purposes it is unnecessary to show contacts in all of the cavities nor to indicate the ends of the contacts and fill-in pins in the cavities of FIG. 1.

For purposes of illustration, a socket contact 21 is shown in cavity 16 and-a fill-in pin 22 is shown in cavity 20. In actual use, the other cavities 17, 18, and 19 would also carry socket contacts. For descriptive purposes, it is unnecessary to show same. For the same reason, in FIG. 1, the ends of the contacts in cavities 16–20 are not shown.

Each cavity is formed by co-axial bores. To illustrate, the cavity 16 is formed by the bore 23 in the shield section 5, by the bore 24 in the contact mounting section 14, and by the bore 25 in the contact crimp section 14. The bore 24 is formed with shoulders 24*a* and 24*b*. The socket-type contact 21 is constructed generally as noted in U.S. Pat. No. 3,178,673.

The contacts are stamped from sheet material and folded around into a joinder head 26 at one end, a crimp head 27 at the opposite end, and an intermediate body 28. The joinder head 26 has a slot 29 which permits flexing for surface grip purpose. The crimp head 27 is folded over and crimped down on the conductor 30 preferably crimping both the wires 31 and insulation 32.

The socket contact 21 is disposed in cavity 16 with the joinder head 26 in the bore 23 of the shield section 5, the intermediate body 28 in the bore 24 of the contact mounting section 14, and the crimp head 27 in the bore 25 of the contact crimp section. The conductor 30 exits away from the contact as shown. The contact is supported in the contact mounting section 13 as follows.

The intermediate body 32 has spring fingers 33 and tabs 34. The contact/conductor assembly is mounted in the wire connector by inserting the joinder head 26 into the bore 25 and pushing into the bore 24. The spring fingers 33 collapse to accomodate the bore 24. Inward motion is continued until the tabs 34 engage the shoulder 24*b*. At that time, the fingers 33 will be released from the bore 24 and extend outwardly so that if the contact is pulled in the opposite direction, the fingers will engage the shoulder 24*a*. The body 32 makes a sliding but relatively firm fit with the bore 24.

The purpose of the fill-in pin 22 is to provide an interference member which will prevent a cable head from being plugged into the wire connector if the head is not correctly oriented. The general shape of the pin 22 is shown in FIG. 4. The pin is molded from a suitable plastic and has a body 36 having a tapered shoulder 37 from which extend flexible arms 40 and 41 each having a tapered flange 42 and 43. The pin is dimensioned to provide for insertion and retention as follows.

The pin is inserted by pushing the flexible arms 40 and 41 into a shield bore such as bore 44 and through the bore 45 where the fingers collapse to accomodate the reduced size of the bore and motion continued until the shoulder 37 contacts the shoulder 45*a*. At that time, the fingers will be released from the bore 24. Motion of the pin in the opposite direction is restrained by the flanges 42 and 43 engaging the shoulder 45*b*.

As mentioned above, no contacts are shown in the cavities 17, 18, and 19 of FIG. 2. However, the conductorswhich would normally be connected to such contacts are indicated at 30*a* in FIG. 2 for illustrative purposes.

The dimensions of the bores in the shield section 5 and the length of the contact joinder head are chosen so that the top of each joinder head is spaced inwardly from the mouth of its bore. Thus, it will be observed that the end 26*a* of contact 21 is spaced inwardly from the mouth 23*a* of the bore 23. The other contacts are similarly disposed in their respective bores. Thus, the shield section overlies the contact.

The wire connector is molded as a single, unitary piece. FIGS. 5 through 8 illustrate the construction of a cable coupler generally indicated at 50. This is a component which is used to interconnect a pair of cable sets for a run longer than the standard cable set length. A cable head on one of the pairs is plugged into one end of the coupler and a cable head in the other pair is plugged into the opposite end. The cable coupler and plugged-in cable heads may rest on an appropriate structure in the plenum or simply may be part of a suspended run.

Referring to FIG. 5, the cable coupler has a pair of elongated generally rectangular shaped outer housing means 51 and 52 which are identical in construction. A single molding die design therefore serves to fabricate each outer housing.

The outer housing 51 has a generally flat main wall 53 and a pair of sub walls 54 and 55 which extend along opposite edges of the main wall and generally normal thereto. Formed on the inside of the respective sub walls are the stoppers 56 and 57 which extend outwardly from the edge of the sub wall. The outer housing 52 has an identical main wall 60, sub walls 61 and 62, and stoppers, one of which is indicated at 63.

The main wall 53 is formed with a plurality of spaced apart parallel buss bar barriers 64. The main wall 60 has identical barriers not shown.

Adjacent the right hand end of housing 51, the sub wall 54 is formed with a pair of abutments 65 and the sub wall 55 formed with a pair of abutments 66. The right hand end is also formed with keyway 67. Adjacent the left hand end of the housing 51 are a pair of abutments 70 and 71.

The housing 52 has identical pair of abutments (not shown) and an identical keyway 72.

The housings 51 and 52 are joined together as noted in FIG. 6 in that the other edges of the corresponding sub walls are in abutting relationship. The housings 51 and 52 are sonically welded together and for this purpose the outer edges of the sub wall are provided with triangular-shaped energy directors (not shown).

When the housings 51 and 52 are joined together the edges of the barriers 64 abut the edges of the corresponding barriers on the main wall 60 that the abutting barriers form a plurality of channels. Also, the pairsof abutments in the housing 51 are vertically aligned with the corresponding abutments. This forms at each end of the assembly, a pair of facing contact block sockets. The channels formed by the barriers and the sockets formed by the abutments are adapted to mount a contact block-/buss bar assembly indicated at 75.

In connection with forming the housings 51 and 52 together note that the pair of stoppers 56 and 57 on the housing 51 are off-set from the pair of stoppers in the housing 52. Thus, the edges of the sub wall can engage without interference. However, if one of the housings, say housing 52, were turned 180°, the stoppers on the housing 51 and the stopper on the housing 52 would engage and prevent the housings from fully engaging. The significance of the foregoing will be commented on later.

The contact block/buss bar assembly 75 will how be discussed.

The assembly 75 includes a pair of contact blocks 76 and 77 and a plurality of conductors in the form of buss bars 78 the opposite ends of which are crimped to contacts on the contact blocks.

The contact blocks 76 and 77 are identical in construction to one another. Also the blocks are identical in the contact block formed by sections 4 and 5 of the wire connector 1 except on the exterior the opposite ends of the shield section 80 are rectangular rather than round and the section 81 (and section 82) is larger than the section 4.

The sections 81 and 82 are adaptdd to fit into the contact block sockets formed by the pairs of abutment 65, etc. described above.

Thus, for assembly purposes, the contact block/buss bar assembly 75 is placed on the housing 51 with the sections 81 and 82 of the contact block nested within the pairs of abutments 70/71 and 65/66. The housing 52 is then placed in position so that the sections 81 and 82 nest within the abutments on housing 52. The sections 81 and 82 engage the main walls 53 and 60. At that point, the buss bars 76 are disposed within the channels formed by barriers 64. The edges of the sub walls are now engaged for sonic welding.

Upon assembly, the inside surfaces of the outer housings, at the opposite ends of the coupler, form interior support surfaces. The support surface for the left hand is indicated at 83. The outer periphery of the shield section 80 serves as an exterior support surface which faces the interior support surface 83. Like the corresponding support surfaces on the wire connector, these support surfaces are employed for the nesting condition.

Interiorly, the contact blocks 81 and 82 have the same construction as the contact block of the wire connector of FIG. 1. This is shown in FIG. 7 for the block 76.

The block 76 has contact shield section 80, contact mounting section 84, and contact crimp section 85. These sections are provided with bores the same as the bores of the wire connectors to form contact cavities 86, 87, 88, 89, and 90 which are likewise adapted to carry contacts or a fill-in pin. In the particular arrangement shown, the cavities 86, 87, and 88 carry contacts and the cavities 89 and 90 carry fill-in pins. The structure of the fill-in pin is the same as the pin 22 of FIG. 4.

In the cable coupler, a set of socket-type contacts is employed in one contact block and a set of pin-type contacts is employed in the other contact block. For present purposes, assume the contact block 76 carries socket-type contacts and that the contact block 77 carries pin-type contacts. The pin contacts have the same construction as the socket contacts (described in connection with FIG. 2) except for the joinder heads as noted below. These contacts fit into the cavities of the blocks 76 and 77 in the same manner as described in connection with FIG. 2.

The pin contact structure is generally shown in FIG. 8 where the contact 91 has a joinder head 92, the crimp head at 93, and the intermediate body by 94. The contact has spring fingers 95 and tabs 96 which cooperate with bore 97 for contact insertion into the contact cavity and for retaining in position the same as the fingers 33 and tabs 34 cooperate with the bore 24.

The crimp head for each type of contact is the same and the manner in which the contacts are crimped to the buss bars is noted in connection with FIG. 8. Each end 100 of each of buss bars 76 has a semi-circular configuration forming an axial slot as generally noted at 101. The crimp head 93 also has a semi-circular configuration which forms an axial slot 102. The ends of the contact crimp head 93 forming the slot 102 are crimped down through the buss bar slot 101 and the same squeezed to hold the bar end and crimp head firmly together.

FIGS. 9, 10, and 11 illustrate a wiring adaptor 103 which has a construction identical to the cable coupler 50 except for a tap-off means which converts the coupler to an adaptor.

The wiring adaptor is secured to a unit for tapping the unit into the flexible wiring system to receive power therefrom. For example, the adaptor may be mounted on the housing of a lighting fixture with a power-in cable head plugged into one end and a power-out cable head tapped into the opposite end with the tap-off feeding the lights in the fixture.

In the wiring adaptor construction, one of the outer housings is molded with a tap-off or bushing for mounting the adaptor on a lighting fixture (other like unit) and providing a passage way for conductors which are crimped to the wiring adaptor buss bars.

In as much as the constructions are identical, the description of the wiring adaptor will be focused on the tap-off or bushing and the conductors.

The outer housing 104 of the adaptor has its main wall 105 molded with a tap-off or bushing 106 which (FIG. 10) mounts the adaptor in an opening 107 on a support wall 108.

The bushing is cylindrical in shape and surrounds the elliptical opening 110 in the main wall 105. The bushing has a peripheral flange 111 and just beyond the flange is formed with a pair of flexible fingers 112 and 113. The fingers have stepped ends **112*a* and 113*a*. The peripheral locus of the fingers is larger than the diameter of opening 107**.

For mounting the wiring adaptor on the support wall, the bushing 106 is pushed down through the opening 107. (with the fingers flexing inwardly toaccomodate the through movement) until the flange 111 engages the support wall 108. At that time the stepped ends **112*a* and 113*a* engage the opening 107**. This secures the wiring adaptor in position.

The inside of the bushing 106 and the elliptical opening 110 in the outer housing provides a passageway 114 for conductors 115 between the adaptor and the inside of a fixture or like unit. Thus, the conductors 115 run up through the passageway 114 into the adaptor wherein they are crimped to the buss bars 116. The crimping operation is accomplished in a manner as described in connection with FIG. 8 with the addition of the wires of the conductors 115 being inserted into the semi-cylindrical end of the buss bar prior to crimping the bars and contacts together.

FIGS. 12, 13, 14, and 15 illustrate the construction of a cable head generally indicated at 120.

This component is used to make up cable sets, that is to say a pair of heads respectively connected on the opposite ends of a flexible cable or one head connected to one end of a flexible cable with the other end having pig tails. The flexible cable conventionally comprises a metal sheath containing one or more insulated conductors.

Cable sets are employed in flexible wiring systems to electrically interconnect various of the system components by one cable being plugged into one component and the opposite cable head plugged into another component. Where the set has a single head and pig tail, the latter are hard wired into the component.

The cable head 120 has an outer housing means comprising first and second outer housing sections 121 and 122. Each is molded as a unitary piece.

The first outer housing section 121 has a base 123 and a side wall 124 which extends partially around and outwardly from the base. Thus, the first section has a hollow configuration with an open end 125.

Opposite the end 125, the side wall 124 extends inwardly as noted at **124*a* and 124*b* and transversely as noted at 124*c*. The extensions 124*a* and 124*b* form an opening 126 and the extension 124*c* has an opening 127. The extension 124*a*, 124*b*, and 124*c* and that portion of the base 123 encompassed by the extentions form a hollow, open-ended cavity 130. The inside surfaces of the extensions 124*a* and 124*b* are contoured so that the portion of the cavity 130** formed thereby is semi-circular.

The base 123 is formed with a semi-circular depression 131 which extends over the cavity 130 from the open end 126 to the open end 127 and slightly beyond same.

Adjacent the open end 125, the side wall 124 carries the latghes 132 and 133.

The second section 122 is formed with a base 134 and a contact block 135. The base 134 is formed with several alignment pins 136 and with a semi-circular- depression 137.

The first and second housings are placed together with the alignment pin 136 being received by appropriate holes in the side wall 124 and the wall in engagement with the base 134. The edge section 140 on the first housing fits into the shoulder 141 on the second housing. The two housings are then sonigally welded together. As in the case of the cable coupler appropriating energy director (not shown) are formed on the edge of wall 124.

When assembled as mentioned above, the depression 131 is aligned with the depression 137 within the confines of the cavity 130. The cavity and the depressions form a socket to hold the sheath 142 of a flexible cable as noted in FIGS. 13–15. For holding the sheath in position, the inside of the cavity 130 is formed with a semi-helical flange 143 (FIG. 14) which fits into the helical groove of the sheath. Additionally, a self-tapping screw 144 is inserted through a hole 145 in the base 123 and screwed down to jam against the sheath helix and cut into the wall extension **124*b***.

The contact block 135 has the same kind of construction as the contact block previously described except for the arrangement of the contact shield section as will be noted below.

Referring to FIG. 13, the contact block has a contact shield section 146, contact mounting section 147, and contact crimp section 148.

The contact shield section rather than being a single piece as previously described is comprised of a plurality of spaced-apart cylindrical members 149 which form individual contact shields.

The sections 146–148 are provided with bores the same structure as the previously described contact blocks to form the several contact cavities 150. In the shield section, the bores are in the members 149. These cavities 150 are adapted to carry contacts or a fill-in pin of the kind previously mentioned. In a cable head, either type of contact is used. For descriptive purposes it is unnecessary to show a fill-in pin nor contacts in the cable head cavities nor the conductor crimped thereto. Just by way of illustration, the conductors which are carried by the sheath 142, are noted at 151 in FIG. 15.

The second outer housing 122 has an extension 153 which surrounds the cylindrically-shaped shields 149. The inner periphery of the extension 153 constitutes an interior support surface while the exterior periphery constitutes an outer support surface. Note that the extension 153 is formed with a key 154.

As mentioned previously, the cable head is adapted to be plugged into a wire connector or to a cable coupler or wiring adaptor. When the cable head is plugged into a wire connector such as connector 1, the shield members 149 move into the bores in the shield section 5 of the contact whereby the same are nested together. The outer surface of -a- member 149 engages the inner surface of the bore in a snug sliding fit. The relative inward motion causes the contacts to nest together. Also, the extention 153 on the cable head assumes a position between the exterior support surface on the shield 5 and the exterior support surface 15 and so the extension 157 is nested between this support surface in a snug but sliding contact. It will be apparent that with the nested condition as above described there are four bands of protective material around the contacts. Also it will be apparent that the nesting condition of the outer housings and the shields makes cocking or lateral displacement of the nested parts virtually impossible.

In connection with plugging in a cable head, the key 154 mates with one of the keyways 67 or 72 depending on whether the condition is for power-in or power-out. In any event, the purpose of the key way is to insure that the cable head and the component it is being plugged into are correctly oriented. As mentioned previously in connection with the cable coupler, the stoppers 56 and 57 will insure that there is a keyway at each end of the coupler for receiving the key of a cable head.

FIG. 16 illustrates the construction of a modular switch tap which is indicated at 155. This component is used in the switch control of a some unit in a flexible wiring system, for example, one or more lighting fixtures. The component has a construction the same as the cable coupler 50 except that means are provided for tapping in a switch and tapping in the controlled unit. In essence, these tap-in means for the switch and controlled unit convert a cable coupler into the modular switch tap.

The modular switch tap is usually mounted on a wire connector or wiring adaptor on a. fixture of other device being controlled. A power-in cable head is plugged into one end and a power-out cable head is plugged into the other end. One of the tap-offs leads directly to the controls switch and the other tap-off to the device being controlled.

The switch 155 has a first outer housing 156, a second outer housing 157, a contact block/buss bar assembly 160. The first outer housing 156 is identical to the first outer housing 51 except that it has an opening 161 in one sub wall and an opening 162 in the opposite sub wall. The housing 157 has corresponding openings. The assembly 160 is identical to the assembly 75 except that conductors 163 and 164 are are crimped to the central section of the buss bars 165.

The tap off means for the switch and the tap off means for the unit to be controlled will next be described.

Extending away from the first opening 161 is a generally semicircular member 166. The corresponding opening on the second housing 157 has a mirror immage member 167. It will be evident that when the housings 156 and 157 are assembled, the members 166 and 167 will form a generally tubular shaped member which covers the opening and extends away from same. The member 166 has a helical flange 170 and the member 167 has a similar flange and the two flanges form a full turn helix.

The tubular member receives the sheath 171 with the flanges fitting into the helical groove of the sheath. A screw is inserted in the holes 172 on the member 167 and screwed down to bear against the sheath 171 and cut into the tubular member. The flanges and screws secure the sheath in position. The opposite end of the conductors 163 may be pig tails as shown to be hard wired into the switch or may be connected to a cable head which is plugged into a wire connector on the housing of the switch.

Extending away from the opening 162 is a housing member 172. The corresponding opening in the outer housing 157 has a mirror image member 173.

The member 172 has a main wall 174 and a pair of sub walls 175 and 176 which correspond to the main and sub walls of the member 156. The member 172 is formed with a socket 177 and the housing 157 is formed with an oppositely disposed socket. The member 172 has a flexible latch 180 and the member 157 has a similar flexible latch 181. The main wall 173 has a key 182.

The contact block 183 has an enlarged section 184 and a plurality of cylindrical members 185. The enlarged section 184 mounts the contact block between the housings 172 and 173 by that the flange 186 fits in the socket 177 and the flange 187 fits in the corresponding socket and with the enlarged section bearing against the main walls of members 172 and 173.

The contact block 183 has the same construction as the contact block 135 of the cable head 120 with the housings 172 and 173 serving the same function as the extension 153.

With the tap-off contact block 183 for the controlled unit having a construction similar to the cable head, the same is adapted to be plugged into a wire connector or a cable coupler or a wiring adaptor. It will be understood that the contact block 183 may be in the form described for the wire connector or the cable coupler. With such structures the tap-off is adapted to receive a cable head.

As mentioned above, the conductors 163 and 164 are arranged for crimping to the buss bar 165. This is done by lancing the buss bar to provide a small raised loop. A. wire is inserted under the loop and the loop closed down on the wire.

As will be apparent, some of the conductors run transverse the barriers 190. For accomodating the conductors the barriers in housing 157 are omitted and the barriers 190 of housing 156 are formed with guideways, the latter being done via semi-circular slots in the edges of the barriers, for example, the slots 191 in barriers 190.

The overlie structure for the contacts has been mentioned heretofore. In FIGS. 17, 18, and 19 we have illustrated the manner in wnich the overlie structure functions to obtain the various advantage referred to. Thus, in FIGS. 17, 18, and 19 we have illustrated the joinder of a wire connector of FIG. 1 and cable head of FIG. 12. The numerals used in these figures for the parts referred to will be the same as used in FIGS. 1 and 12.

Assume that the wire connector 1 is fixed in the position shown and that the cable head is located to the right spaced away from the wire connector.

The cable head is moved to the left and the outer housing 153 of the cable head starts to nest or move within the outer housino 2 of the wire connector. The support surfaces of the components make a snug sliding fit and the components begin to be correctly axially aligned. This initiates the alignment of the pin and socket contact 91 and 21.

As the cable head continues motion to the left the cable head shields 149 begin to nest or enter the wire connector shields 5. The axial alignment process is enhanced.

The foregoing nesting condition is particularly illustrated in FIG. 17.

As the wire connector cohtinues to move toward the left, the nested condition is increased and the pin contact 91 approaches the socket contact 21. The condition when the contacts are just about ready to engage (and the pin nests within the socket) is illustrated in FIG. 18. It will be observed that there are four bands of protective material surrounding the contacts 21 and 91; i.e. the shield 149, the shield 5, the outer housing 153, and the outer housing 2. The shields form bands immediately around the contacts and the outer housings form bands simmilarly spaced for the contacts.

As the wire connector is further moved toward the left, the maximum amount of nesting of the outer housing and the shields occurs when the outer housing 153 bottoms in the wire connector as illustrate in FIG. 19. At that point, the contacts 21 and 91 are fully nested.

In FIG. 19 it will be observed that the flexible latch and the cable head are engaged with the keepers on the wire connector This is illustrated by the latch 132 at keeper 10.

The availability of material for arc quenching is best illustrated in FIG. 18 where, if the cable head were to be moved to the right (under load), the protective bands constitute substantial material in the event of arcing as the contact separates.

We claim:

1. For an electrical power distribution system, a component in the form of an improved cable coupler comprising:

elongated first and second outer housing means, each of identical construction;

each said outer housing means having a generally flat, rectangular-shaped main wall and a pair of sub walls extending normally outwardly therefrom along the respective edges of the main wall and the inside surface of each sub wall having a stopper that extends outwardly beyond the edge of its sub wall;

corresponding sub walls of the first and second outer housing means abutting one another along corresponding edges and being sonically welded to secure the housing means together and the respective sub walls forming side walls, the main walls and side walls forming a hollow structure with opposite ends open and in said abutting condition of the housing, said stoppers being spaced from one another;

adjacent each of said open ends, the inside of each sub wall being formed with a pair of abutments, the abutments being arranged to form, on the respectives side walls, a pair of facing contact block sockets;

each of said outer housing means including the main walls, the side walls, and the abutments being molded from plastic material as a unitary piece;

at each of said open ends, the interior of the main walls and the interior of the side forming an interior support surface;

a first contact block secured in one pair of said sockets;

a second contact block secured in the other pair of said sockets;

said first contact block being formed with a first contact shield section, a first contact mounting section, and a first contact-crimp section, the sections being serially arranged one after another;

a first exterior support surface formed on said first contact shield section and facing one of said interior support surfaces;

a plurality of spaced-apart, parallel, cylindrical bores formed in said first contact shield section;

a plurality of spaced-apart, parallel bores formed in said first contact mounting section respectively co-axial with said bores in the first contact shield section;

a plurality of spaced-apart, parallel bores formed in said first contact crimp section respectively co-axaal with said bores in the first contact mounting section;

said plurality of co-axial bores respectively forming a plurality of first contact cavities extending through the first contact block;

a first set of elongated contacts respectively in said cavities and each contact having a joinder head;

means securing said first set of contacts respectively to said bores of said first contact mounting section with the joinder heads respectively disposed in said bores of said first contact shield section and the end of each joinder head being spaced inwardly from the mouth of its bore whereby said first exterior support surface and said first shield section overline the contacts;

said second contact block being formed with a second contact shield section, a second contact mounting section, and a second contact crimp section, said second sections being serially arranged one after another;

a second exterior support formed on said second contact shield section and facing the other of said interior support surfaces;

a plurality of spaced-apart, parallel, cylilndrical bores formed in said second contact shield section;

a plurality of spaced-apart, parallel bores formed in said second contact mounting section respectively co-axial with the bores in the second contact shield section;

a plurality of spaced-apart, parallel bores formed in said second contact crimp section respectively co-axial with the bores in the second contact mounting section;

said plurality of co-axial bores respectively forming a plurality of second contact cavities extending through the second contact block;

a second set of elongated contacts respectively in said second contact cavities, each contact including a joinder head;

means securing said second set of contacts respectively to said bores of said second mounting section with the joinder heads respectively disposed in said bores of said second contact shield section and the end of last said joinder heads being spaced inwardly from the mouth of its bore whereby said second exterior support surface and said second shield section overlie the contacts;

a plurality of conductors in the form of buss bars; and the opposite ends of each buss bar being respectively connected to a contact of said first set and a contact of said second set, each last said connections being respectively disposed in said contact crimp section.

2. The cable coupler of claim 1 wherein said first set of contacts are the pin type and the second set of contacts are the socket type.

3. The cable coupler of claim 1 furthr including:

a pair of key ways, one keyway formed in the interior support surface of one main wall at one of said open ends and the other keyway formed in the interior support surface of the other main wall at the opposite of said open ends, each said keyway being adapted to receive a key on a cable head and said stoppers on the first and seconds housings insuring said opposite end keyways will be in the desired location so that the housings cannot be put into said abutting condition due to engagement of said stoppers unless the housing are oriented so that said keyways are at opposite ends of the coupler.

4. The cable coupler of claim 1 having additional structure which converts the cable coupler to a wiring adaptor, the additional structure including:

means on one of said main walls forming an opening located centrally of the main wall, the means forming said opening causing the outer housing thereof to be identical to the other outer housing except for said means;

a bushing surrounding said opening and extending away from the outside of last said one main wall;

a flange on said bushing;

a pair of flexible fingers formed on said bushing;

said flange and said flexible fingers being for use in mounting the wiring adaptor on a support wall by that the flange engages the top side of the support wall and the flexible fingers engage the underside of the support wall; and said opening, said bushing, said flange, and said flexible fingers being molded when said one main wall is molded.

5. The cable coupler of claim 1 having additional structure which coverts the cable coupler to a modular switchtap, the additional structure including:

means on one of said side walls forming a first opening;

means on the other of said side walls forming a second opening;

a tubular-shaped member covering said first opening and extending away from the first opening, the tubular-shaped member having means for securing a flexible cable therein and the hollow structure providing a passageway for conductors of the cable to enter the switchtap unit for connection to at least some of said buss bars;

a third outer housing means surrounding said second opening and extending outwardly therefrom, the third outer housing means including a third contact block;

said third contact block formed with a third contact shield section, a third contact mounting section, and a third contact crimp section, said sections being serially arranged one after another;

a plurality of parallel, cylindrical bores respectively formed in said third contact shield section;

a plurality of spaced-apart, parallel bores formed in said third contact mounting section respectively co-axial with the bores in the third contact shield section;

a plurality of spaced-apart, parallel bores formed in said third contact crimp respectively co-axial with the bores in the third contact mounting section;

said plurality of co-axial bores respectively forming a plurality of third contact cavities extending through the third connector block;

a third set of elongated contacts respectively in said third contact cavities, each contact including a joinder head; and means securing said third set of contacts respectively to said bores of said third contact mounting section with the joinder heads respectively disposed in said bores of the third contact shield section with the end of each joinder head being spaced inwardly from the mouth of its bore whereby said third outer housing and the third contact shield section overlie the contacts.

* * * * *